US009947521B2

(12) United States Patent
Brown et al.

(10) Patent No.: US 9,947,521 B2
(45) Date of Patent: Apr. 17, 2018

(54) AUXILIARY GAS INLET

(71) Applicant: Micromass UK Limited, Wilmslow (GB)

(72) Inventors: Jeffery Mark Brown, Hyde (GB); Rainer Cramer, Reading (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/155,669

(22) Filed: May 16, 2016

(65) Prior Publication Data

US 2016/0336157 A1 Nov. 17, 2016

(30) Foreign Application Priority Data

May 15, 2015 (GB) ..... 1508328.0

(51) Int. Cl.
*H01J 49/04* (2006.01)

(52) U.S. Cl.
CPC ..... *H01J 49/0404* (2013.01); *H01J 49/04* (2013.01); *H01J 49/0418* (2013.01)

(58) Field of Classification Search
CPC ..... H01J 49/0404; H01J 49/04; H01J 49/0418
USPC ..... 250/281, 282, 286, 288
See application file for complete search history.

(56) References Cited

U.S. PATENT DOCUMENTS

| | | | |
|---|---|---|---|
| 5,318,752 | A | 6/1994 | Visser |
| 6,649,908 | B2 | 11/2003 | Apffel, Jr. et al. |
| 6,707,037 | B2 | 3/2004 | Whitehouse |
| 6,770,875 | B1 | 8/2004 | Guevremont et al. |
| 6,806,468 | B2 | 10/2004 | Laiko et al. |
| 7,470,899 | B2 | 12/2008 | Atherton et al. |
| 9,293,315 | B2 | 3/2016 | Makarov |
| 2005/0269518 | A1 | 12/2005 | Bajic et al. |
| 2010/0282966 | A1 | 11/2010 | Schneider et al. |

*Primary Examiner* — Nicole Ippolito
*Assistant Examiner* — Hanway Chang
(74) *Attorney, Agent, or Firm* — Womble Bond Dickinson (US) LLP; Deborah M. Vernon; Heath T. Misley

(57) ABSTRACT

There is provided a method of introducing ions into a mass spectrometer, comprising ionising a sample using a Matrix Assisted Laser Desorption Ionisation ("MALDI") ion source to form a plurality of ions, transporting said plurality of ions in a first, primary gas through a passageway and into an inlet of a mass spectrometer, introducing a second, auxiliary gas into said inlet, and controlling a flow rate of said second gas into said inlet so as to control a flow rate of said first gas through said passageway.

15 Claims, 5 Drawing Sheets

AUXILIARY GAS INLET

CROSS-REFERENCE TO RELATED APPLICATION

This application claims priority from and the benefit of United Kingdom patent application No. 1508328.0 filed on 15 May 2015. The entire content of this application is incorporated herein by reference.

BACKGROUND

The present disclosure relates to a method of introducing ions into a mass spectrometer and an ion inlet device.

The coupling of ionization sources such as Matrix Assisted Laser Desorption Ionisation ("MALDI") to the vacuum of a mass spectrometer may be done through a differential pumping aperture, such as a capillary or small orifice inlet. Low ion transfer efficiency through the inlet may represent a major bottleneck. Over recent years, for increased sensitivity, the inlet orifice of the mass spectrometer has been enlarged in order to collect and transmit more and more ions into the system. A limitation of increasing the inlet orifice can be the size and cost of the associated pumping system.

An increased inlet flow may lead to significantly increased heater power requirements for a required desolvation temperature. Maintaining the exterior wall of an inlet capillary at a particular temperature can be ineffective at heating the gas within the capillary, for example generating a mixture of solvated and desolvated ions.

US2010/282966 (Schneider) discloses a method and system for a vacuum driven mass spectrometer interface with adjustable resolution and selectivity.

EP0607908 (Visser) discloses a method and apparatus for sampling a reactive atmosphere into a vacuum chamber of an analyser.

WO2013/076307 (Makarov) discloses a high duty cycle ion spectrometer.

It is desired to provide an improved method of introducing ions into a mass spectrometer.

SUMMARY

According to an aspect of the present disclosure there is provided a method of introducing ions into a mass spectrometer, comprising:

ionising a sample using a Matrix Assisted Laser Desorption Ionisation ("MALDI") ionisation source to form a plurality of ions;

transporting the plurality of ions in a first, primary gas through a passageway and into an inlet of a mass spectrometer;

introducing a second, auxiliary gas into the inlet; and controlling or adjusting the flow rate of the second gas into the inlet so as to control or adjust the flow rate of the first gas through the passageway.

Ions entering said inlet may not be filtered and/or separated, or may not have been filtered and/or separated according to their mass and/or mass to charge ratio and/or ion mobility. This is in contrast to US2010/282966 (Schneider), which uses an auxiliary flow of gas to alter the transit time of ions through a differential ion mobility spectrometer, which filters and separates ions according to their ion mobility.

The ions entering the inlet may be unfiltered.

This method improves the flow of ions through a passageway that leads to an inlet of a mass spectrometer, by providing an effective control of the gas flow containing the plurality of ions as they travel through the passageway, using the auxiliary gas.

Various embodiments disclosed herein may provide an additional degree of freedom for controlling the temperature and/or the gas residence time in a passageway, for example an atmospheric pressure inlet capillary, without resorting to a high powered, expensive capillary heater.

Furthermore, the flow regime in the passageway can be easily manipulated between turbulent and laminar flow, for example by controlling the flow rate of the second gas into the inlet as described herein.

The control (e.g., flow rate) of the auxiliary gas can also be applied relatively quickly without having to wait, for example, for time constraints associated with a bulky capillary heater arrangement.

All of (or substantially all of) the second gas may travel into the inlet, for example from the source of the second gas. This is distinct from some conventional arrangements (e.g., Schneider) wherein some of the second gas is used as a curtain gas to decluster ions from a high performance liquid chromatography. The mass spectrometer and/or passageway may not have a curtain gas. A curtain gas may not be provided or associated with the continuous ion source.

The passageway may be at atmospheric pressure. The net flow of gas may be through the passageway and into the inlet of the mass spectrometer. The passageway may be in the form of a tube. The passageway may be substantially free of a differential electric field, for example an RF and/or DC electric field.

The length of the passageway may be at least 2, 3, 4, 5 or 10 times its width (e.g., diameter and/or smallest width).

The flow rate of the second gas into the inlet may influence the flow rate of the first gas through the passageway. The flow rate of the second gas into the inlet may have a substantially indirect correlation with the flow rate of the first gas through the passageway.

Adjusting the flow rate of the second gas may cause a corresponding (e.g., inverse) adjustment in the flow rate of the first gas through the passageway or heated capillary.

The flow rate of the second gas into the inlet may be controlled or adjusted by a flow control device, for example a restriction device for restricting the flow of the second gas. A gas source (e.g., a tank or container of gas) may be provided and substantially all of the gas from the gas source may be used as the second, auxiliary gas.

The step of introducing a second, auxiliary gas into the inlet may comprise introducing the second gas through a cone surrounding the inlet. The passageway may be a first passageway and the second auxiliary gas may be introduced through a second passageway. The cone may form part of, for example an end of, the second passageway. The first passageway and/or the second passageway may be sealed against the inlet.

The step of introducing a second, auxiliary gas into the inlet may comprise introducing the second gas into said inlet substantially with the first gas and/or at the same time as the first gas.

The step of controlling the flow rate of the second gas may comprise continuously varying the flow rate of the second gas into the inlet.

The step of controlling the flow rate of the second gas may comprise increasing the flow rate of the second gas into the inlet, optionally so as to increase the residence time of the plurality of ions in the passageway.

The step of controlling the flow rate of the second gas may comprise decreasing the flow rate of the second gas into the inlet, optionally so as to decrease the residence time of the plurality of ions in the passageway.

Increasing the residence time of the plurality of ions in the passageway may increase their temperature upon exiting the passageway.

The passageway may comprise a capillary, for example a heated capillary.

The heated capillary may be resistively and/or inductively heated, for example by a resistive and/or inductive wire wrapped around the capillary. The region of the capillary that is heated, for example inside an inductive wire, may be a heated zone, and the step of controlling the flow rate of the second gas into the inlet may comprise controlling the flow rate of the first gas through the heated zone. The heated capillary may be at atmospheric pressure. A heater or heater control may be arranged and adapted to control the temperature of the capillary, for example maintain the temperature of the capillary at a set temperature.

The method may comprise controlling (e.g., increasing or decreasing) the flow rate of the second gas into the inlet to control (e.g., increase or decrease respectively) the the generation of multiply charged ions within the heated capillary, whilst optionally keeping the temperature of the capillary constant and/or keeping the heater or heater control at a constant set temperature or output.

Controlling the flow rate of the second gas into the inlet may control the flow rate of the first gas through the heated zone.

The heated capillary may be heated to aid the desolvation of ions and/or the generation of multiply charged ions in the first gas. The passageway and/or heated capillary may be at atmospheric pressure.

The step controlling the flow rate of the second gas may comprise controlling the flow rate of the second gas into the inlet so as to optimise the desolvation of ions and/or the generation of multiply charged ions in the first gas, for example as they travel through the passageway.

The method may further comprise determining a flow rate, for example an optimum flow rate, of the second gas that provides sufficient desolvation or thermal dissociation of ions, or sufficient multiply charged ions, in the first gas, for example as the first gas travels through the passageway. The method may further comprise introducing the second, auxiliary gas into the inlet at said determined, or optimum flow rate. The term "sufficient" should be construed as referring to a predetermined amount or intensity of desolvated and/or desalted, dissociated, singly or multiply charged ions.

The passageway may be located between an atmospheric pressure source of ions and a first vacuum stage of a mass spectrometer. A curtain gas may not be provided or associated with the atmospheric pressure source of ions.

The inlet may be substantially sealed, such that substantially the only gases flowing into the inlet are the first gas and the second gas.

The inlet may be one of a plurality of inlets, said plurality of inlets leading to or forming the entrance to a first vacuum stage of a mass spectrometer.

Ions travelling through the inlet may originate from a single ion source.

The second gas may be neutral, non-ionic or contain substantially no ions.

The second gas may be introduced into a flow of the first gas, and optionally after the first gas has been transported through the passageway.

The method may further comprise:

introducing the second gas into the inlet at a flow rate sufficient to cause the flow of the first gas through the passageway to be laminar; and/or introducing the second gas into the inlet at a flow rate sufficient to cause the flow of the first gas through the passageway to be turbulent.

The method may further comprise:

increasing the flow rate of the second gas into the inlet until the flow of the first gas through the passageway is laminar; and/or increasing the flow rate of the second gas into the inlet until the flow of the first gas through the passageway is turbulent.

The Reynolds number of the first gas as it travels through the passageway may have an indirect correlation with the flow rate of the second gas.

The method may further comprise adjusting the Reynolds number of the first gas as it travels through said passageway, for example by controlling or adjusting the flow rate of the second gas into the inlet.

The step of adjusting the Reynolds number of the first gas may comprise lowering the Reynolds number of the first gas as it travels through said passageway, for example by increasing the flow rate of the second gas into the inlet, such that the first gas exhibits laminar flow through said passageway.

The step of adjusting the Reynolds number of the first gas may comprise increasing the Reynolds number of the first gas as it travels through said passageway, for example by decreasing the flow rate of the second gas into the inlet, such that the first gas exhibits turbulent flow through said passageway.

The step of ionising a sample may comprise ionising the sample at atmospheric pressure.

The inlet may lead to, or form an entrance to, a first vacuum stage of a mass spectrometer.

The features described above may apply equally to the methods and aspects of the disclosure described below.

According to an aspect of the disclosure, there is provided a method of mass spectrometry comprising a method as described above.

According to an aspect of the disclosure, there is provided an ion inlet device comprising:

a Matrix Assisted Laser Desorption Ionisation ("MALDI") ion source for generating a plurality of ions;

a passageway for transporting the plurality of ions in a first, primary gas into an inlet of a mass spectrometer;

an auxiliary gas source arranged and adapted to introduce a second, auxiliary gas into the inlet with the first gas; and a control system arranged and adapted to control the flow rate of the second gas into the inlet so as to control the flow rate of the first gas through the passageway.

Ions entering said inlet may not be filtered and/or separated or may not have been filtered and/or separated according to their mass and/or mass to charge ratio and/or ion mobility.

The ion inlet device may comprise a plurality of passageways or an array of passageways for introducing ions into a mass spectrometer. One or more, or all of the passageways may comprise a respective auxiliary gas source arranged and adapted to introduce a respective auxiliary gas into each respective passageway with the respective primary gas, for example in the same manner as described in any of the above methods.

The control system may be arranged and adapted to control the flow rate of the respective auxiliary gases so as to control the flow rate of the respective first gases through their respective passageways.

According to an aspect of the disclosure, there is provided a mass spectrometer comprising an ion inlet device as described above.

According to an aspect of the disclosure, there is provided a method comprising:

providing a heated primary inlet capillary to a mass spectrometer;

providing an auxiliary inlet gas stream at a junction of the primary inlet capillary; and optimising the flow of the auxiliary inlet gas so that the overall gas flow and temperature within the primary inlet more effectively assists in the desolvation of ions or the generation of multiply charged ions.

Ions entering said inlet may not be filtered and/or separated or may not have been filtered and/or separated according to their mass and/or mass to charge ratio and/or ion mobility.

The method may further comprise causing thermal dissociation due to elevated temperatures of the gas flow within the inlet capillary.

The method may further comprise changing from turbulent to laminar flow regimes within the capillary inlet, for example as a result of optimising the flow of the auxiliary inlet gas.

According to an embodiment the mass spectrometer may further comprise:

(a) one or more ion guides; and/or (b) one or more ion mobility separation devices and/or one or more Field Asymmetric Ion Mobility Spectrometer devices; and/or (c) one or more ion traps or one or more ion trapping regions; and/or (d) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (e) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (f) one or more energy analysers or electrostatic energy analysers; and/or (g) one or more ion detectors; and/or (h) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (i) a device or ion gate for pulsing ions.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii)

about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

According to an embodiment analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to an embodiment the process of Electron Transfer Dissociation fragmentation comprises interacting analyte ions with reagent ions, wherein the reagent ions comprise dicyanobenzene, 4-nitrotoluene or azulene.

BRIEF DESCRIPTION OF THE DRAWINGS

Various embodiments of the present disclosure will now be described, by way of example only, and with reference to the accompanying drawings in which.

DETAILED DESCRIPTION

Figure 1:
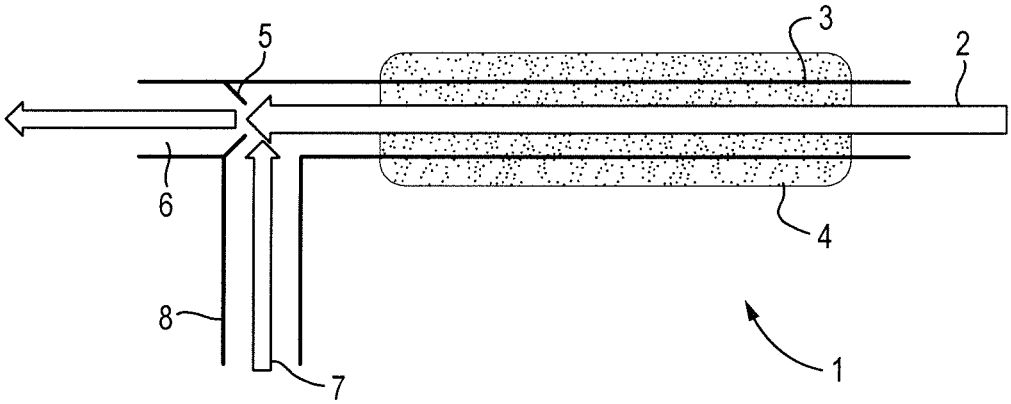
FIG. 1 shows a preferred embodiment of the present disclosure.

The present disclosure relates generally to a method of introducing ions into a mass spectrometer. The method involves ionising a sample using a Matrix Assisted Laser Desorption Ionisation ("MALDI") ionisation source to form a plurality of ions, and transporting the plurality of ions in a first, primary gas through a passageway and into an inlet of a mass spectrometer. A second, auxiliary gas is introduced into the inlet, and the flow rate of the second gas into the inlet is controlled, so as to control a flow rate of the first gas through the passageway.

Various embodiments disclosed herein are more specifically aimed at controlling the multiple charging of ions (e.g., peptides) in a passageway (e.g., a heated capillary). In such applications the passageway is typically provided in the form of an elongated, heated tube. Ions may pass through the passageway and the application of heat to the ions in the passageway may cause them to be multiply charged.

The passageway may be substantially free of an electric field, for example a differential electric field and/or an RF and/or DC electric field. This distinguishes the passageway from, e.g., an RF-confined region of the mass spectrometer, such as an ion mobility separator or ion guide.

Adjusting the flow rate of the second gas may cause a corresponding (e.g., inverse) adjustment in the flow rate of the first gas through the passageway or heated capillary. This may increase the residence time of ions within the heated portion of the capillary, so that they can undergo further charging. A control system could be provided that controls the flow rate of the second gas into the inlet, for example using a flow control device.

The inlet to the mass spectrometer may be an inlet to the first vacuum chamber of the mass spectrometer. The ions entering the inlet may be 'raw' or unprocessed ions, which may refer to ions that have not undergone any type of filtering and/or separation and/or manipulation and/or alteration (other than that described herein).

For example, ions entering the inlet may not be separated, or may not have been separated according to their mass and/or mass to charge ratio and/or ion mobility. The processes within the inlet capillary may encompass effects such as space charge changes, laminar and turbulent flow regimes, diffusion, surface ionisation effects, such as Solvent Assisted Inlet Ionisation ("SAII"), but these effects may be considered not to process ions in order to manipulate or alter their structure.

The ions entering the inlet may be unfiltered, which is distinct from some conventional arrangements in which ions may be filtered according to mass, mass to charge ratio or ion mobility prior to entering the inlet. Ions produced by the Matrix Assisted Laser Desorption Ionisation ("MALDI") ionisation source may not be filtered between their creation and entering the inlet of the mass spectrometer.

The method may comprise determining an optimum flow rate of the second gas that generates sufficient multiply charged ions in the first gas as the first gas travels through the passageway, and introducing the second gas into the inlet at the optimum flow rate.

In other embodiments, the optimum flow rate may provide sufficient thermal dissociation of ions within the passageway.

The step of controlling the flow rate of the second gas may comprise increasing or decreasing the flow rate of the second gas into the inlet, so as to increase or decrease the residence time of the plurality of ions in the passageway.

An embodiment of the present disclosure will now be described.

FIG. 1 shows a schematic of an ion inlet device 1 optionally comprising a first, primary gas 2 that may be transported through a first passageway 3. The primary gas may be a gas carrying ions from an ion source (e.g., an Matrix Assisted Laser Desorption Ionisation ("MALDI") ionisation source 15 as described below).

The first passageway 3 may be provided in the form of an elongated tube. That is, the length of the first passageway 3 may be at least 2, 3, 4, 5 or 10 times its width (e.g., diameter). As the first passageway 3 increases in length, a corresponding increase in dwell time of ions within the first passageway 3 may be achieved. As such, all of these values will have an increased dwell or residence time of ions over passageways that are shorter in length.

Ions, at least some of which may be solvated, may pass through the first passageway 3 and the application of heat to the ions in the first passageway 3 may generate an increased amount of multiply charged ions in or at the end of the first passageway 3.

The first passageway 3 may be in the form of a heated capillary. A plurality of ions may be present in the first gas 2, which has optionally originated from an ion source (not shown). The ions may be in the form of droplets transported with the primary gas 2. The first passageway may comprise a heated zone 4 for heating the first gas 2, and optionally for heating ions that may be present in the first gas. The length of the heated zone 4 may be at least 2, 3, 4, 5 or 10 times the width (e.g., diameter) of the heated capillary and/or first passageway 3. An increase in length of the heated zone 4 may lead to a corresponding increase in dwell or residence time of ions within the heated zone 4, which may generate an increased amount of multiply charged ions in or at the end of the heated zone 4.

An inlet 5 may be provided that optionally forms the entrance to a first vacuum stage 6 of a mass spectrometer. The inlet 5 may be the inlet to a first vacuum stage of the mass spectrometer. Prior to entering the inlet 5, ions may be substantially 'raw' or unprocessed, and the ions entering the inlet 5 may have not undergone any type of separation, manipulation or alteration (other than that described herein). For example, ions entering inlet 5 may not be separated according to mass, mass to charge ratio or ion mobility, or have undergone any type of collision or reaction processes.

Gas entering the first vacuum stage may expand adiabatically as it travels through the inlet 5. The first gas 2 optionally enters the inlet 5 upon exiting the first passageway 3. The first passageway 3 may be a tube and/or may be fluidly sealed around its circumference so that all of the gas entering the first passageway 3 may also enter the inlet 5 of the mass spectrometer.

A second, auxiliary gas 7 may be introduced into the inlet 5, optionally through a second passageway 8. An outlet (or the end) of the second passageway 8 is optionally located adjacent to the inlet 5, and optionally downstream of the heated zone 4. Locating the outlet downstream of the heated zone 4 may increase the influence of the auxiliary gas 7 on the flow of primary gas 2 through the first passageway 3 as described below. The inlet 5 is optionally sealed against the first passageway 3 and the second passageway 8, such that the only gas flowing into the inlet 5 is optionally the first gas 2 and the second gas 7.

The flow rate V may represent the gas admitted through the inlet 5 into the vacuum system. The flow rate A may represent the flow rate of the first gas through the first passageway 3, and the flow rate C may represent the flow of the second gas through the second passageway 8. It will be appreciated that V may be equal to the sum of A and C. Accordingly, if C is increased then, assuming V is substantially constant, A will decrease by substantially the same amount. This may represent a 'sealed' system as described herein, in which the inlet 5 of the mass spectrometer is substantially sealed against the first passageway 3 and the second passageway 8. In an unsealed system, whilst the variation of a flow rate of auxiliary gas might affect a primary gas, it may not be controlled to the same accuracy as is achievable with a sealed system.

The first passageway 3 may be substantially free of an electric field, for example a differential and/or RF and/or DC electric field. This distinguishes the first passageway 3 from, e.g., an RF-confined region of the mass spectrometer, such as an ion mobility separator or ion guide, which typically comprise a number of electrodes arranged and adapted to apply such RF and DC electric fields. Such fields may be configured to confine ions radially within the ion mobility separator or ion guide or drive ions through such components. The first passageway 3 of the present disclosure may simply be a heated tube in which ions may be driven therethrough by the flow of the first gas 2.

Various embodiments may be aimed at controlling the dwell or residence time of ions within the heated zone 4 in order to control the generation of multiply charged ions by adjusting the flow rate of the auxiliary gas. It has been found that, with Matrix Assisted Laser Desorption Ionisation ("MALDI"), liquid droplets may occur during the desorption process. It appears from auxiliary gas experiments that appropriate desolvation may be required to generate multiply charged ions.

Desolvation is distinct from e.g., declustering, which refers to gas phase ions, rather than droplets in liquid phase. Declustering refers to the application of energy (e.g., a curtain gas) to clusters in gas phase, and is distinct from desolvation as described herein.

The response time of a flow control device may be substantially quicker than that of a heater. Where previously the generation of multiply charged ions may have been controlled by, e.g., increasing the output of the heater, various embodiments of the present disclosure may be directed to controlling the generation of multiply charged ions by adjusting the flow rate, as opposed to the output of a heater (e.g., a heated zone 4, 400, or heater 450 as described below and herein). The output of the heater may remain substantially constant whilst the flow rate of the auxiliary gas is controlled or adjusted.

The first passageway 3 may be arranged and adapted to generate multiply charged ions in the flow of primary gas 2 through the first passageway 3. The ions in the primary gas 2 may comprise at least some singly charged ions, or the majority of ions in the primary gas 2 may initially be singly charged.

By controlling the flow rate of the second gas 7 into the inlet 5 the flow rate of the first gas 2 through the first passageway 3 may be controlled, and the transit time of the ions through the first passageway 3 may be tuned so as to optimise the degree of multiple charging of ions within the first passageway 3.

Figure 2:
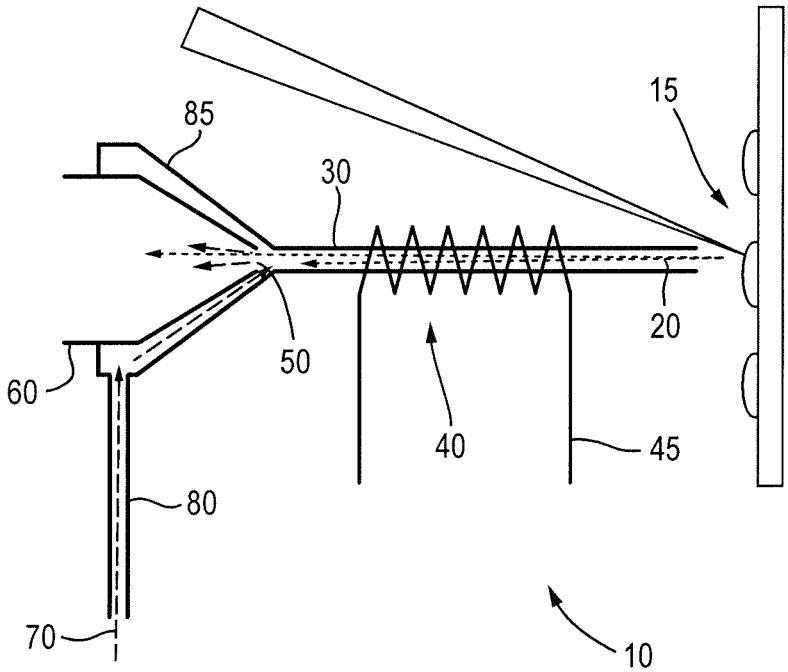
FIG. 2 shows an embodiment of the present disclosure applied to a MALDI ion source.

FIG. 2 shows an embodiment of the present disclosure, and shows an ion inlet device 10 optionally comprising a Matrix Assisted Laser Desorption Ionisation ("MALDI") ion source 15. The MALDI source may include a sample, for example a liquid sample, mixed with a suitable matrix material, which sample may be irradiated by a pulsed laser. This may trigger ablation and desorption of the sample and matrix material. Analyte molecules may be ionised in the hot plume of ablated gases, for example through protonation.

Ions produced by the ion source 15 may travel through a first passageway 30 in a first gas 20, which may be an ambient gas (such as natural air) and can be heated in a heated zone 40 of the first passageway 30. The heating of charged droplets in the first passageway 30 may cause ions to desolvate from the matrix molecules. The heated zone 40 may be heated by a heater 45, optionally in the form of an induction heater comprising an induction wire that may be wrapped around the first passageway 30 to define the heated zone 40.

The first gas 20 optionally enters an inlet 50 upon exiting the first passageway 30. The inlet 50 may form the entrance to a first vacuum stage 60 of a mass spectrometer. Prior to entering the inlet 50 the ions may be unseparated or unfiltered, and/or may not have been separated or filtered.

A second, auxiliary gas 70 may be introduced into the inlet 50, for example through a second passageway 80. The end of the second passageway 80 is optionally located adjacent to the inlet 50, and optionally downstream of the heated zone 40. The inlet 50 is optionally sealed against the first passageway 300 and the second passageway 800, such that the only gas flowing into the inlet 50 may be the first gas 20 and the second gas 70.

A device 85, for example a cone may be provided that is located concentrically around the inlet 50, which device 85 may be configured to supply the second or auxiliary gas 70 equally around the perimeter or circumference of the inlet 50, such that the flow of second gas around the inlet 50 may be in the form of a cone gas.

An experiment was conducted in relation to the FIG. 2 embodiment, in which 10 mg of α-cyano-4-hydroxycinnamic acid ("HCCA") or 2,5 dihydroxybenzoic acid ("DHB") was dissolved in 1 mL of 50:50 water:acetontrile. To this, 250 μL of glycerol was added. Finally, 1 μL of analyte solution was mixed with 1 μL of matrix solution on-target.

The inlet capillary or device had the following characteristics:

Length: 6 cm
Inner diameter: 1.0 mm
Cone orifice diameter: 0.8 mm
Material: stainless steel
Temperature near heater element: 250° C.
Gap to target plate: 2 mm
Heater element: resistive wire 40 Ω/m, 10 cm long
MALDI target plate voltage: +3500 V
Capillary voltage: 0 V The upper limit of gas flow through the capillary can be estimated (approximately) by calculating the throughput of the 0.8 mm orifice into the vacuum. This may be in series with the capillary and, as such, the true flow rate will be lower due to the increased resistance. For air at 20° C., the volumetric flow, S in litres per second through an aperture of area A in $cm^2$ may be given by $S=2\times A$. Reference is made to J. M. Lafferty, Ed. "Foundations of vacuum science and technology", Wiley, New York, 1998, pp. 105-120.

For the geometry used here the upper estimate of volumetric flow may be calculated at 100.5 $ccs^{-1}$ (equivalent to 100.5 $mbar\cdot liter\cdot s^{-1}$ throughput). The mean gas velocity into the capillary may be the volumetric flow rate divided by the cross sectional area $S/A=12800\ cms^{-1}$ (or 128 $ms^{-1}$). Given the length of the capillary, this may equate to a mean transit time in the capillary of approximately 0.5 ms. In reality, the flow rate may be lower, possibly extending the transit time.

Further calculations may indicate that the Reynolds number at the capillary is high (e.g. greater than 8000) at low or zero cone gas, forming a turbulent flow regime. Whereas at high cone gas values, the Reynolds number can be arranged to drop below 2000 and into the regime of laminar flow.

Figure 3:
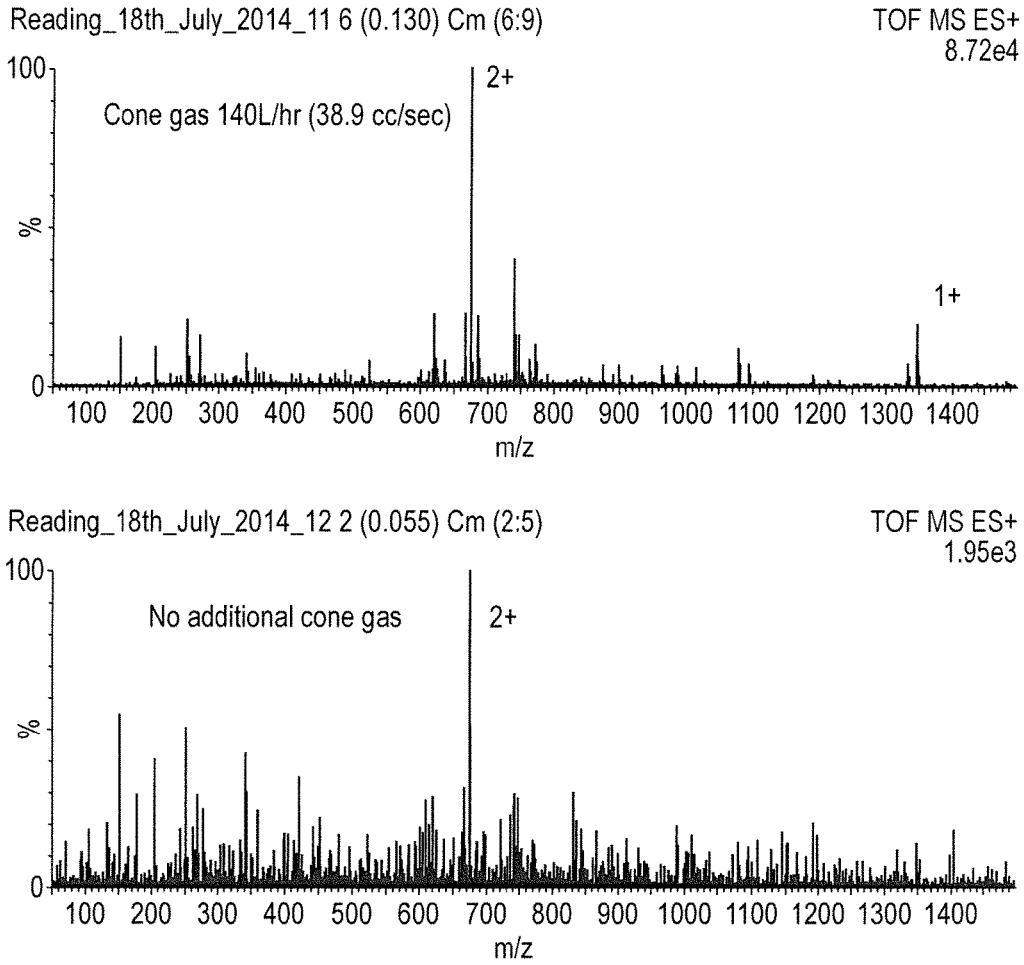
FIG. 3 shows a graph comparing the spectra produced for a given substance at a given auxiliary gas flow rate, versus no auxiliary gas flow.

FIG. 3 shows Liquid MALDI (atmospheric pressure) spectra comparing the effect of 140 $Lh^{-1}$ cone gas (top graph) versus no cone gas (bottom graph) on the abundance of the $[M+2H]^{2+}$ and $[M+H]^{+}$ molecular ions.

Figure 4:
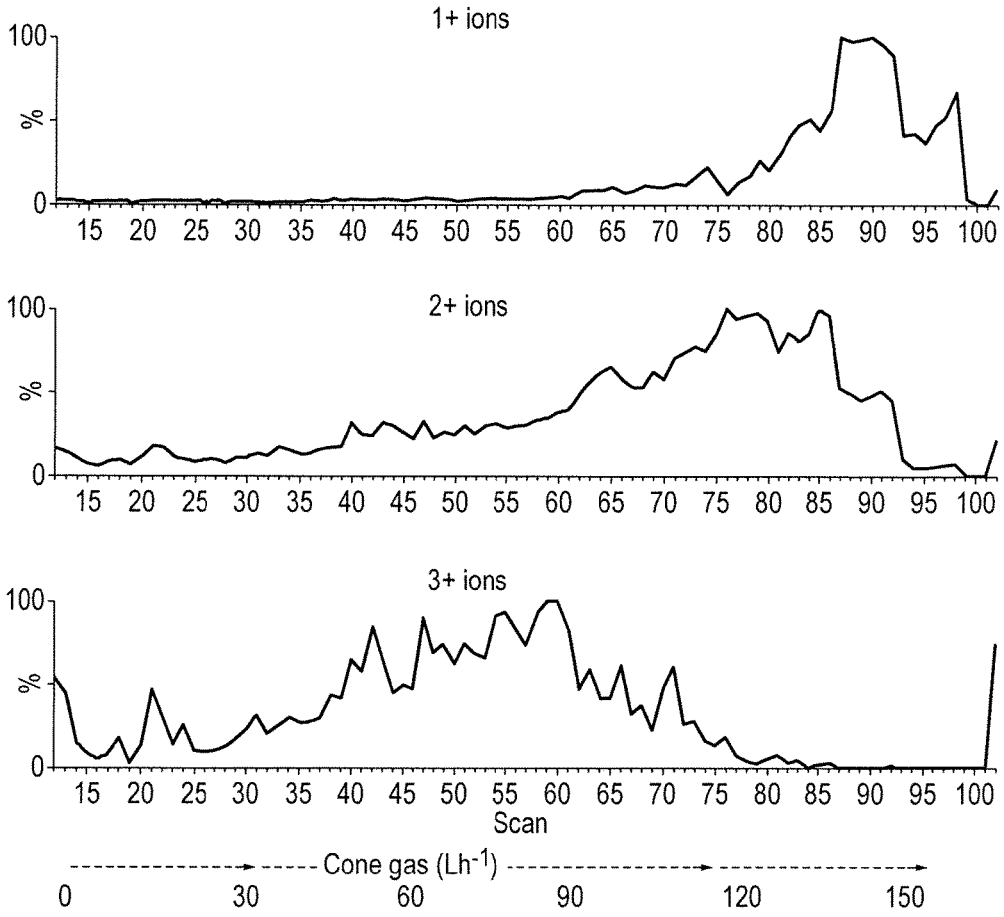
FIG. 4 shows a graph of mass chromatograms for different charge states as a function of auxiliary gas flow rate.

FIG. 4 shows Liquid MALDI (atmospheric pressure) mass chromatograms for the different charge states of the molecular ions $[M+H]^{+}$, $[M+2H]^{2+}$ and $[M+3H]^{3+}$ as a function of the cone gas flow which was increased over the course of the acquisition.

Figure 5:
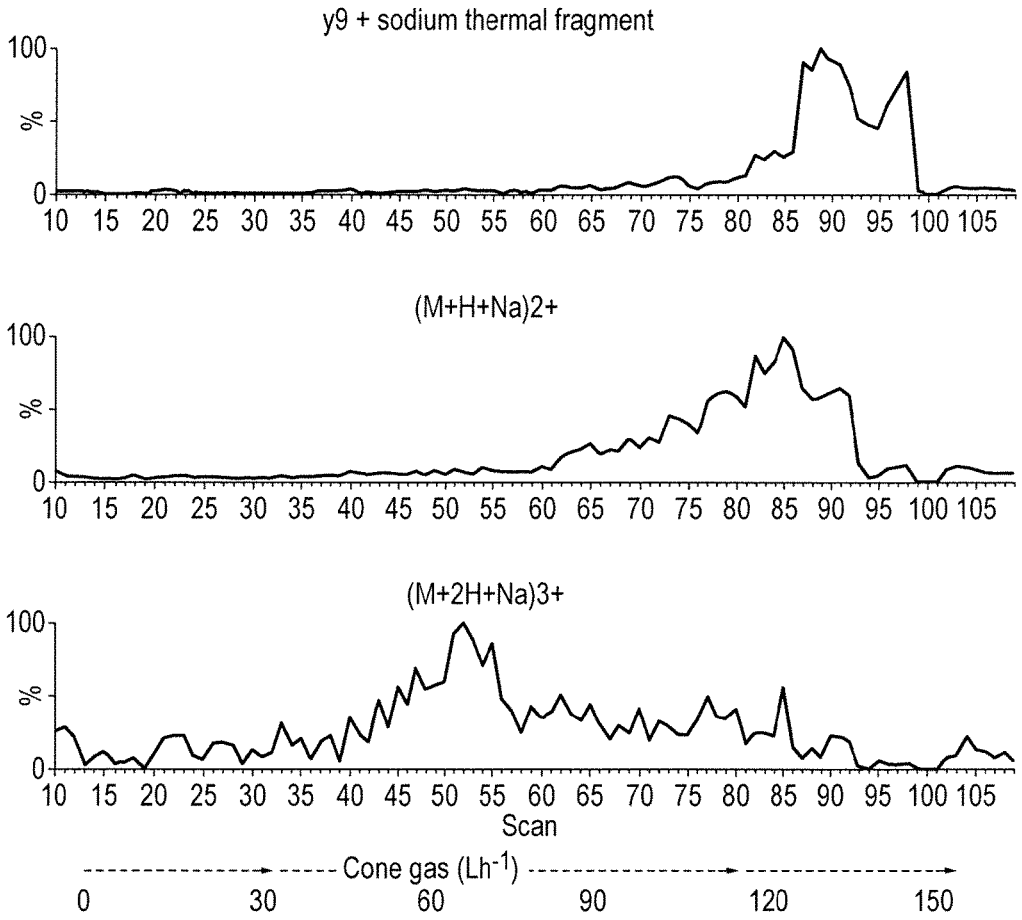
FIG. 5 shows a graph of mass chromatograms for different charge states as a function of auxiliary gas flow rate.

FIG. 5 shows Liquid MALDI (atmospheric pressure) mass chromatograms for the thermal induced singly charged sodiated y9 fragment ions, the molecular ions $[M+H+Na]^{2+}$ and the molecular ions $[M+2H+Na]^{3+}$ as a function of the cone gas flow which was increased over the course of the acquisition.

Figure 6:
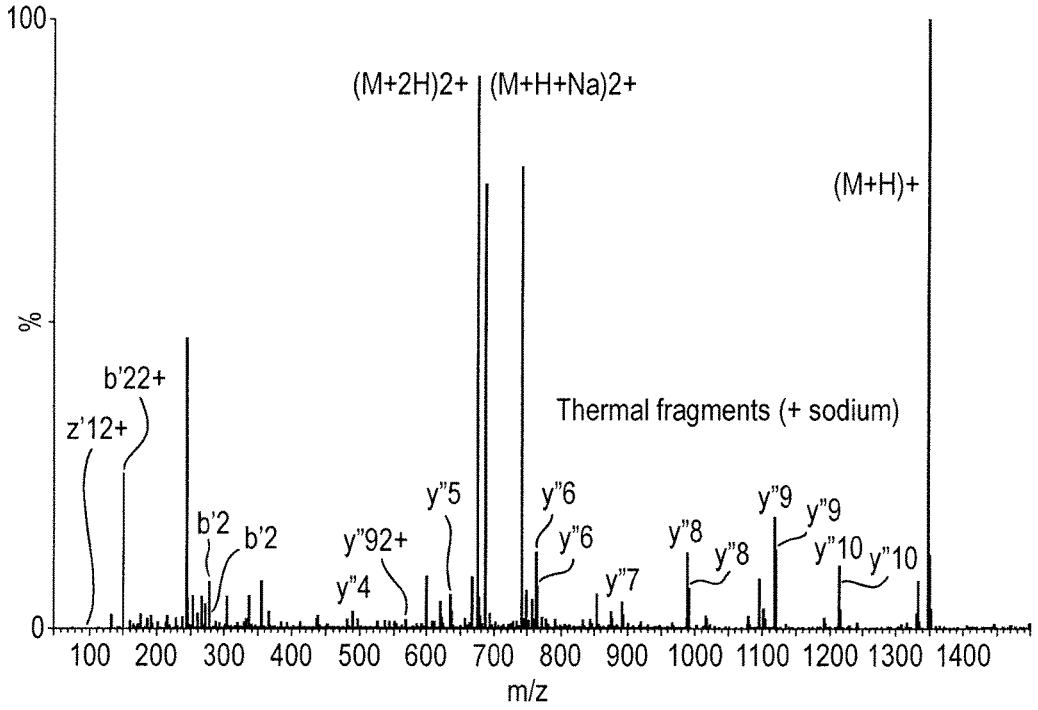
FIG. 6 shows a graph of product ions produced from thermal dissociation within the heated capillary of FIG. 2, for a substance P and a given flow rate of auxiliary gas.

FIG. 6 shows Liquid MALDI (atmospheric pressure) spectrum showing annotated sodiated y product ions from thermal dissociation within the heated transfer capillary with a cone gas flow of 140 $Lh^{-1}$.

In Matrix Assisted Laser Desorption Ionisation ("MALDI"), and optionally Liquid MALDI, the residence time of a droplet to the heat in a carrier gas, and possibly direct interactions with inlet surfaces, can be key to the generation of multiply charged ions. With MALDI, droplets (in liquid phase) may also occur during the desorption process, and it has been found that appropriate desolvation may be required to generate multiply charged ions. Desolvation is distinct from e.g., declustering, which refers to gas phase ions, rather than droplets in liquid phase. Declustering refers to the application of energy (e.g., a curtain gas) to clusters in gas phase, and is distinct from desolvation as described herein.

Increasing the flow of the auxiliary gas may cause a corresponding decrease in the flow of the primary inlet carrier gas carrying the desorbed droplets and ions. The auxiliary gas in the embodiments and experiments described herein may be sealed at the junction with the inlet capillary, enhancing these effects. The mean velocity of the gas may reduce due to these effects, which increases the temperature of the primary gas through increased heat transfer, as the cooling effect on the heated walls is optionally reduced. In addition, there is an increased transit time for desolvation. It has been found that increasing the temperature and transit time may significantly increase the desolvation of ions in the primary gas flow. It has also been found that more lower charged ions may be observed as the flow rate of the auxiliary gas is increased.

It has also been found that inhomogeneous gas streams (in terms of temperature) may be detrimental to the analysis of certain ion species, for example that require distinct or finely tuned desolvation temperatures and gas flows. As such, maintaining all of the gas flow at a relatively homogenous temperature would be particularly beneficial for the analysis of monoclonal antibodies ("MAB"), membrane proteins or non-covalent complexes that require a more refined degree of desolvation. The embodiments described herein allow maintenance of the ionic gas flow at a homogenous temperature.

The present disclosure may relate to a method of introducing ions as described above. Various embodiments disclosed herein are more specifically aimed at maintaining the gas flow in the passageway (e.g., a heated capillary) at a given temperature or temperature state (e.g., homogeneity) by adjusting or controlling the flow rate of the auxiliary gas into the inlet.

It has also been found that the temperature of an inlet capillary may need to be regulated to optimize the degree of multiple charging of ions, for example peptides observed from, for example, a liquid MALDI (atmospheric pressure) ion source. Conventionally, it may have been a challenge to provide a heater with sufficient power density to heat a gas flow within an inlet capillary of, for example 1 mm internal diameter.

The embodiments disclosed herein may involve the use of an auxiliary gas flow connected, and optionally sealed, to the downstream portion of a heated inlet capillary. This can be effective at simultaneously controlling both the gas flow and gas temperature of the inlet gas, and can provide enhancements in the generation of multiply charged ions, for example in MALDI and/or enhancements in the desolvation process, for example in liquid MALDI.

The overall effect provided by the auxiliary gas may be to reduce the flow rate of the primary gas. The overall flow of gas into the low pressure region, for example the first vacuum stage, of the mass spectrometer optionally remains substantially constant.

As such, the flow rate of the primary gas may be reduced by the magnitude of the flow rate of the auxiliary gas. The reduced flow rate of the primary gas may allow more time for the primary gas to be heated, optionally causing an increase in temperature of the gas, for example when using the same heater power as in a conventional ion inlet device.

The desolvation and ionization processes within the inlet capillary may encompass one or more of space charge effects, laminar and turbulent flow regimes, diffusion, surface ionisation effects and desolvation effects from, for example MALDI.

The flow rate of the second gas into the inlet may be used to control the flow regime of the first gas in the passageway (e.g., first passageway 30). For example, certain flow rates of the second gas may be determined that correspond to certain flow regimes of the first gas in the passageway.

One flow regime may be referred to as a turbulent flow regime, in which the flow of the first gas in the passageway is at least partly turbulent, such as comprising eddies or vortices.

An alternative flow regime may be a laminar flow regime, in which the flow of the first gas through the passageway is laminer. For example, in laminar flow the fluid (i.e., the first gas) may flow in parallel layers, with no disruption between the layers, and/or the fluid may not exhibit eddies or vortices. In turbulent flow the fluid (i.e., the first gas) may not flow in parallel layers and/or there may exist disruptions between the layers.

A control system could be provided that controls the flow rate of the second gas into the inlet, for example using a flow control device. The control system may receive an instruction to cause the flow of the first gas within the passageway to correspond to a desired flow regime (e.g., a turbulent or laminar flow regime). The control system may be arranged and adapted to then adjust the flow rate of the second gas into the inlet, for example using the flow control device, to a flow rate that has been determined to correspond to the desired flow regime.

In various embodiments the methods disclosed herein may comprise introducing the auxiliary gas into the inlet of the mass spectrometer at a flow rate sufficient to cause the flow of said first gas through said passageway to be laminar.

The methods may further comprise introducing the second gas into the inlet of the mass spectrometer at a flow rate sufficient to cause the flow of said first gas through said passageway to be turbulent.

Although the present disclosure has been described with reference to preferred embodiments, it will be understood by those skilled in the art that various changes in form and detail may be made without departing from the scope of the disclosure as set forth in the accompanying claims.

The invention claimed is:

1. A method of introducing ions into a mass spectrometer, comprising:

ionising a sample using a Matrix Assisted Laser Desorption Ionisation ("MALDI") ionisation source to form a plurality of ions;

transporting said plurality of ions in a first, primary gas through a passageway and into an inlet of a mass spectrometer, wherein ions entering said inlet are not separated according to their ion mobility;

introducing a second, auxiliary gas into said inlet; and controlling a flow rate of said second gas into said inlet so as to control a flow rate of said first gas through said passageway.

2. A method as claimed in claim 1, further comprising determining an optimum flow rate of said second gas that provides sufficient multiply charged ions in said first gas as said first gas travels through the passageway, and introducing said second gas into said inlet at said optimum flow rate.

3. A method as claimed in claim 1, wherein said step of controlling the flow rate of said second gas comprises increasing or decreasing the flow rate of said second gas into said inlet, so as to increase or decrease the residence time of said plurality of ions in said passageway.

4. A method as claimed in claim 1, wherein said passageway comprises a heated capillary.

5. A method as claimed in claim 1, further comprising determining an optimum flow rate of said second gas that provides sufficient desolvation or thermal dissociation of ions in said first gas as said first gas travels through the passageway, and introducing said second gas into said inlet at said optimum flow rate.

6. A method as claimed in claim 1, wherein said inlet is substantially sealed, such that substantially the only gases flowing into said inlet are said first gas and said second gas.

7. A method as claimed in claim 1, wherein ions travelling through said inlet originate from a single ion source.

8. A method as claimed in claim 1, wherein said second gas is neutral, non-ionic or contains substantially no ions.

9. A method as claimed in claim 1, wherein said second gas is introduced into a flow of said first gas, and after said first gas has been transported through said passageway.

10. A method as claimed in claim 1, further comprising:

introducing said second gas into said inlet at a flow rate sufficient to cause the flow of said first gas through said passageway to be laminar; and/or introducing said second gas into said inlet at a flow rate sufficient to cause the flow of said first gas through said passageway to be turbulent.

11. A method as claimed in claim 1, wherein said step of ionising a sample comprises ionising said sample at atmospheric pressure.

12. A method as claimed in claim 1, wherein said inlet forms an entrance to a first vacuum stage of a mass spectrometer.

13. A method of mass spectrometry comprising a method as claimed in claim 1.

14. An ion inlet device comprising:

a Matrix Assisted Laser Desorption Ionisation ("MALDI") ion source for generating a plurality of ions;

a passageway arranged and adapted to transport said plurality of ions in a first, primary gas therethrough and into an inlet of a mass spectrometer, so that ions entering said inlet are not separated according to their ion mobility;

an auxiliary gas source arranged and adapted to introduce a second, auxiliary gas into said inlet; and a control system arranged and adapted to control the flow rate of said second gas into said inlet so as to control the flow rate of said first gas through said passageway.

15. A mass spectrometer comprising an ion inlet device as claimed in claim 14.

* * * * *